United States Patent [19]

LaBate

[11] 4,262,885

[45] Apr. 21, 1981

[54] PREFABRICATED CONSUMABLE BLAST FURNACE RUNNER

[76] Inventor: Micheal D. LaBate, 115 Hazen Ave., Ellwood City, Pa. 16117

[21] Appl. No.: 123,369

[22] Filed: Feb. 21, 1980

[51] Int. Cl.[3] ..... C21B 7/14

[52] U.S. Cl. ..... 266/196; 266/236; 193/2 R

[58] Field of Search ..... 266/196, 236; 193/2 R

[56] References Cited

U.S. PATENT DOCUMENTS

| | | | |
|---|---|---|---|
| 3,174,739 | 3/1965 | Miller | 266/196 |
| 3,600,480 | 8/1971 | Parsons | 266/196 |
| 4,039,172 | 8/1977 | Yoshida | 266/281 |

*Primary Examiner*—M. J. Andrews

*Attorney, Agent, or Firm*—Webster B. Harpman

[57] ABSTRACT

A runner for hot metal as from a blast furnace is formed of a series of interconnected modular units which are prefabricated from consumable combustible, and/or disintegrable materials of desired densities resulting in a calculated exposure life determined by the amount, the time and the temperature of the molten metal handled by the runners. The modular runners are formed of a mixture including clay, wood chips, paper pulp and/or any combustible material, which when mixed or blended with any refractory produces a consumable, disintegrating combustible mixture that has a disintegration or combustion rate dictated by the density of the compaction of the material in the finished product.

12 Claims, 4 Drawing Figures

PREFABRICATED CONSUMABLE BLAST FURNACE RUNNER

BACKGROUND OF THE INVENTION (1) Field of the Invention

This invention relates to hot metal runners as used in the metal producing industry for delivering molten metal from a source to a remote point.

(2) Description of the Prior Art:

Runners for handling hot metal are disclosed in U.S. Pat. No. 2,409,741 and such runners generally comprised metal shapes with clay liners as will be understood by those skilled in the art.

U.S. Pat. No. 3,174,739 relates to a nose for a furnace tap hole runner and wherein the nose, like the runners with which it is used, comprises a metal shape having a refractory lining in the nature of a permanent monolithic layer.

U.S. Pat. No. 3,365,187 shows a runner system for a blast furnace.

The runners in general use at the time of the patent's filing comprised clay shapes, some of which were carried in metal shells.

U.S. Pat. No. 3,480,125 shows a fibrous insulating material and a channel which is noted as being used to convey molten metal in a foundry and U.S. Pat. No. 3,600,480 relates to a process of repairing runners and describes the runner itself as being made of refractory material with an inside lining composed of clay and carbon.

The prior art runners were primarily refractory articles, sometimes with a metal jacket and sometimes with a lining formed of a refractory material and an additive. They were all designed and formed of materials the would have the longest possible life and most of them were capable of being repaired as disclosed in the prior art U.S. Pat. No. 3,600,480, mentioned hereinabove.

SUMMARY OF THE INVENTION

The present invention relates to a runner for receiving and guiding molten metal from a blast furnace or the like, the runner being formed of consumable, combustible, or disintegrable material as a result of its subjection to the heat of the molten metal so that it is expendible and largely consumed or disintegratd at a predetermined time which is precalculated to conform with the amount of metal, the time of exposure and the temperature of the molten metal that flows through runners formed in accordance with the invention. By providing a consumable, combustible, disintegrable, expendible runner, the runner patterns on a pouring floor may be readily re-established by replacing the consumed units at regular intervals so that each new pour of metal is insured of satisfactory runner life to handle the pour without the need of emergency diverting of the metal due to failure of the runners as frequently occurs in the prior art practice. The runner of the present invention can be produced from readily available materials such as clay, dolomite wood chips, or sawdust, paper pulp and the like with phenolic resin as a binder or any similar resin together with sodium silicate so that the resulting runner module has the desired combustible disintegrable known lifetime.

In a preferred embodiment as described herein, the material is formed in the desired shape as by ramming or impaction, either in a unitary body or in a body built up of progressively rammed or packed layers and the final layer provided with a graphite coating. The life of the consumable, expendible runner is increased as the normal erosion pattern caused by impact of the molten metal is eliminated due to the ability of the graphite coating to resist erosion whereby the runner will maintain its desired shape. By maintaining the desired shape of the runner a hard refractory cap can be used to cover the runner and the molten metal therein and thus confine the smoke and fumes and flames normally associated with moving hot metal so that they can be collected at spaced points in a practical manner preventing atmospheric pollution.

DESCRIPTION OF THE PREFERRED EMBODIMENT

Figure 1:
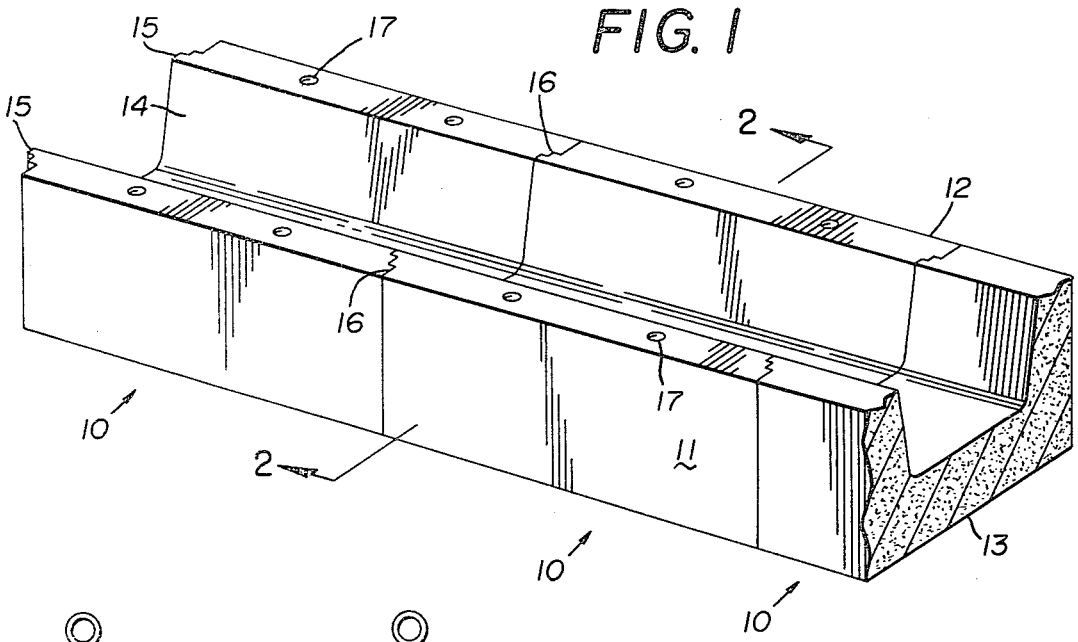
FIG. 1 is a perspective view of several of the modular runner units assembled in end to end relation with parts of one of the units broken away and shown in cross section.
Figure 2:
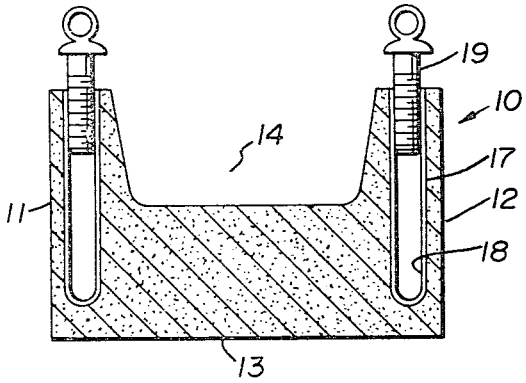
FIG. 2 is a sectional elevation of one of the runners of FIG. 1 showing attachment means installed in openings preformed in the runners.

By referring to the drawings and FIGS. 1 and 2 in particular, it will be seen that a portion of a hot metal runner has been disclosed and which comprises two modular units, each of which is generally indicated by the numeral 10 and each of which has substantially vertically spaced sides 11 and 12 and a bottom 13.

Figure 3:
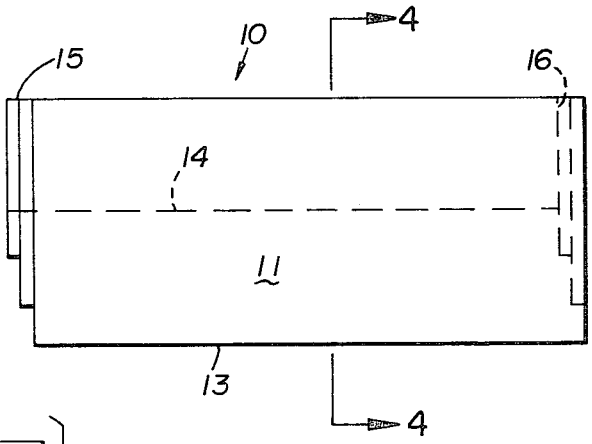
FIG. 3 is a side elevation of one of the runners seen in FIG. 1.

As illustrated in FIGS. 1 and 2 of the drawings, each of the runners 10 is shaped to provide a trough 14 through which molten metal such as iron from a blast furnace or steel form an open hearth can be directed. The runners may be of various practical sizes capable of handling the flow of metal from the tap hole of the furnace and each of the modular runners 10 is preferably formed with stepped extensions 15 axially thereof which are adapted to register in inwardly stepped shoulders 16 in the opposite end of the adjacent modular unit 10. The outwardly stepped extensions 15 and the inwardly stepped shoulders 16 are best illustrated in FIG. 3 of the drawings and by referring again to FIG. 1 of the drawings it will be seen that the end to end alignment of the modular runner unit 10 is defined by the face to face engagement of the stepped extensions 15 in the stepped shoulders 16.

Still referring to FIG. 1 of the drawings, it will be observed that there are a plurality of openings 17 formed in the upper parallel top edges of the runners units 10 and by referring to FIG. 2 of the drawings it will be seen that fastener formations including sleeves 18 and eyelet carrying bolts 19 can be engaged therein so that the individual modular runner units 10 can be readily handled by mechanical equipment and positioned in end to end relation in establishing a desired path or trough for the molten metal.

Figure 4:
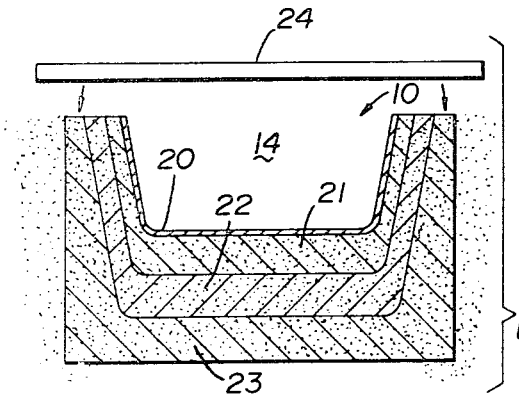
FIG. 4 is a composite view showing a runner in cross section embedded in the ground of the pouring floor with the desirable layer-like formation illustrated together with a refractory cap for enclosing the hot metal trough defined by the modular runner.

In FIG. 4 of the drawings, the metal engaging surface of the trough 14 is illustrated as having a colloidal graphite coating 20, the colloidal graphite incorporating sub-micron particle size in a liquid suspension applied to the surface of the modular runner unit 10. Also in FIG. 4 the unit 10 is shown in exaggerated detail as being comprised of three separate and distinct compacted or rammed layers of the combustible and/or disintegrable material with the uppermost layer being indicated by the numeral 21, the middle layer by the numeral 22 and the lowermost or outermost layer by the numeral 23.

It has been determined that by compacting or ramming the material from which the modular runner units are formed to different degrees of density, the life of the modular unit and the runner trough or path formed of a plurality of such units can be predetermined to match a desired metal conducting time with the graphite coating 20 insuring against erosion of any particular part of the several modular units.

It has been determined that in addition to the consumable materials hereinbefore mentioned, any consumable material may be used. It has also been determined that the clay ingredient hereinbefore mentioned can be used by itself or in mixtures including dolomite, sand, granulated slag and ground fired clay. A typical suitable mixture may comprise 17% by weight wood chips or sawdust, about 61% by weight clay or dolomite, and about 22% by weight of resin urea formaldehyde or sodium silicate. The consumable, combustible or disintegrable runner module can be produced with any type of phenolic resin or other glue or glue-like binders.

In producing the modular runner unit a mold is used to provide the desired shape into which the premixed material is positioned and compacted to the desired density by the use of a die movable into the mold to form the material into desired density. Preferably a first layer is compacted and each additional layer is added separately to form a solid mass of the desired length and thickness which may obviously be varied depending on the amount of molten metal to be handled, the time of flow, and the desired life of the runner. After shaping the modular runner unit is heat dried.

The modular runner unit disclosed herein has the additional advantage of providing a heat insulating structure so that runners formed of the units deliver the molten metal with very small loss of temperature and which action contributes to the rapid flow of the molten metal without any pooling or freezing such as is common in the use of the present refractory non-combustible non-consumable runners.

Again referring to FIG. 4 of the drawings, it will be seen that the modular runner unit is shown embedded in pouring floor F and that a cover block 24 is illustrated, several of which are used to cover the completed runner.

It will occur to those skilled in the art that various changes and modifications may be made in the invention disclosed herein without departing from the spirit thereof or from the scope of the appended claims.

Having thus described my invention what I claim is:

1. A hot metal runner unit comprising an elongated trough-like body member having a base and spaced parallel upstanding side sections wherein said runner unit is a solid compacted heat dried shape of consumable and disintegrable material having a predetermined lifetime when subjected to molten metal flowing therethrough.

2. The hot metal runner unit set forth in claim 1 and wherein the consumable and disintegrable material comprises organic and inorganic material characterized by being combustible so as to lose its initial shape upon combustion.

3. The hot metal runner unit set forth in claim 1 and wherein a refractory material such as clay is incorporated in the material.

4. The hot metal runner unit set forth in claim 1 and wherein the consumable and disintegrable material comprise one or more such materials from a group including wood chips, sawdust, paper pulp, rice hulls, dolomite and various resins, natural and synthetic.

5. The hot metal runner unit set forth in claim 1 and wherein the unit is formed of several layers of said material each compacted to a different degree.

6. The hot metal runner unit set forth in claim 1 and wherein a graphite coating is penetrated into the metal receiving areas of said unit and the graphite is applied as a sub-coloidal particle size in a liquid carrier.

7. The hot metal runner unit of claim 1 and wherein fasteners are positioned in the upper parts of said side sections to enable lifting means to be attached thereto.

8. The hot metal runner unit set forth in claim 1 and wherein the opposite ends of said runner unit are stepped, one end inwardly and one end outwardly, so as to form inter-engaging configurations on adjacent runner units in axial allignment and engagement.

9. The hot metal runner set forth in claim 1 and wherein the consumable material comprises paper pulp, and the disintegratable material comprises dolomite and a cover block is positione thereon.

10. The hot metal runner set forth in claim 1 and wherein the consumable material comprises paper pulp and the disintegratable material comprises dolomite and sodium silicate is present as a binder.

11. The hot metal runner set forth in claim 1 consisting essentially of about 17% by weight sawdust, 61% by weight dolomite, and 22% by weight sodium silicate.

12. The hot metal runner set forth in claim 1 and consisting essentially of about 17% by weight paper pulp, 61% by weight dolomite and 22% by weight resin as a binder.

* * * * *